US006201500B1

(12) United States Patent
Fujikawa

(10) Patent No.: US 6,201,500 B1
(45) Date of Patent: Mar. 13, 2001

(54) DUAL FREQUENCY ANTENNA DEVICE

(75) Inventor: Hiroshi Fujikawa, Tokyo (JP)

(73) Assignee: SMK Corporation (JP)

( * ) Notice: Subject to any disclaimer, the term of this patent is extended or adjusted under 35 U.S.C. 154(b) by 0 days.

(21) Appl. No.: 09/238,860

(22) Filed: Jan. 28, 1999

(30) Foreign Application Priority Data

Jun. 12, 1998 (JP) ..... 10-164616

(51) Int. Cl.[7] ..... H01Q 1/24; H01Q 1/36
(52) U.S. Cl. ..... 343/702; 343/895
(58) Field of Search ..... 343/702, 895, 343/900, 901, 725, 729; H01Q 1/24, 1/36

(56) References Cited

U.S. PATENT DOCUMENTS 5,764,191 * 6/1998 Tsuda ..... 343/895
5,945,953 * 8/1999 Tsuda et al. ..... 343/895
6,075,488 * 6/2000 Hope ..... 343/895

* cited by examiner

*Primary Examiner*—Hoanganh Le
(74) *Attorney, Agent, or Firm*—Morrison Law Firm

(57) ABSTRACT

First and second helical antenna elements are connected in series with a radio signal. The first helical antenna element resonates at a first frequency as a ¼-wavelength antenna. The series combination of the first and second helical antenna elements resonates as a ¾ wavelength antenna at a second frequency respectively. The two frequencies differ by less than a factor of three. A retractable rod antenna shorts out one of the antenna elements in an extended position at which it is connected to the radio, and is disconnected from the radio in its retracted position. The rod antenna resonates as a ¼-wavelength antenna at the first frequency.

3 Claims, 9 Drawing Sheets

(a)

(b)

DUAL FREQUENCY ANTENNA DEVICE

BACKGROUND OF THE INVENTION

1. Field of the Invention

The present invention relates to an antenna device provided for a portable radio such as a portable cellular phone and, more particularly, to an antenna device which enables transmission and reception of signals at two different frequencies.

2. Description of the Related Art

In a portable radio device, such as a portable cellular phone, which is used while being carried outside, a whip antenna projecting from a housing of the radio is retracted into the housing so as to make the radio as compact as possible while the radio is being carried.

This type of portable radio uses a helical antenna constantly connected to feeding hardware to enable transmission and reception of a signal regardless of whether the whip antenna is housed in the housing or extended. Japanese Patent Publication of Translated Version (PCT) No. Hei-9-505956 discloses an antenna device which resonates at two radio different frequencies even while a whip antenna is retracted into the housing.

Referring now to FIG. 9, a prior art antenna device 100 comprises a fixed antenna section 130 and a slide antenna section 103. The fixed antenna section 130 includes a first helical antenna element 116 consisting of a first coil and a second helical antenna element 114 consisting of a second coil. Both antenna elements are helically wrapped around a cylindrical insulating sleeve 104. The coils are connected at one end to a conductive sleeve 109 attached to one end of the insulating sleeve 104. The conductive sleeve 109 is electrically connected to transmission and reception circuits of a portable radio (not shown), thus constituting means for attaching the antenna device 100 to the portable radio.

The slide antenna 103 is a rod antenna element disposed below an insulating cover 125. Slide antenna 103 passes through the insulating sleeve 104 and the conductive sleeve 109. The slide antenna 103 can be extended from and retracted into the portable radio in the axial direction.

When the slide antenna 103 is retracted to a housed position, the rod antenna element is positioned below the conductive sleeve 109. The rod antenna element is disconnected from the conductive sleeve 109 by means of the insulating cover 125 and hence is out of use. As shown in an equivalent circuit diagram shown in FIG. 10, the fixed antenna 130 is connected to the conductive sleeve 109, and the first and second helical antenna elements 116 and 114 resonate at resonance frequencies f11 and f12.

As shown in FIG. 11, when compared with the capability of an antenna device having one helical antenna which resonates at frequency f10 (denoted by a dashed line in FIG. 11), the bandwidth capability of the antenna device 100 covers a much wider range.

When the slide antenna 103 is extended, the lower end of the rod antenna element is electrically connected to the conductive sleeve 109, and the rod antenna acts as a whip antenna resonating at the frequency f10.

The conventional antenna device 100 enables transmission and reception of a signal regardless whether the slide antenna 103 is housed or extended. Further, as shown in FIG. 11, while the slide antenna 103 is housed, the antenna device 100 enables transmission and reception of a radio signal at two frequencies f11 and f12.

In recent years, a frequency band used for mobile communications equipment has differed from field to field. For example, an automobile telephone is allocated a range of 900 MHz, and a personal handyphone system (PHS) is allocated a range of 1.9 GHz. There is a desire for a portable radio capable of being used with both communications system. For this reason, there has been desired what is called a dual-band-capable antenna device which enables transmission and reception of a signal at either of the bands.

However, in the previously-described conventional antenna device 100, when the slide antenna section 103 is housed, the fixed antenna section 130 enables transmission and reception of a signal over a broad range. To this end, the two helical antenna elements are adjusted so as to resonate at comparatively close frequencies f11 and f12. Accordingly, the conventional antenna device 100 does not cope with communication at completely different frequency bands. If an attempt is made to cope with such communication through use of an antenna which is identical structure with the conventional antenna device 100, there is a need to connect the two helical antenna elements 114 and 116 having completely different extended strengths to the conductive sleeve 109 with a side-by-side configuration. This results in not only impairment of appearance of the portable radio but also an increase in the number of components, thereby rendering assembly of the portable radio laborious.

The conventional antenna device 100 causes only the rod antenna elements to serve as an antenna while the slide antenna section is extended. Accordingly, the antenna device 100 cannot enable the rod antenna elements to cope with two completely different frequency bands. Consequently, the conventional antenna device 100 cannot cause the antenna elements to resonate at two completely different frequencies and to enable transmission and reception of a signal at respective frequencies regardless of whether the slide antenna is housed or extended.

OBJECTS AND SUMMARY OF THE INVENTION

The present invention has been conceived to solve the foregoing problems. Accordingly, it is an object of the present invention to provide an antenna device which enables a portable radio to transmit and receive signals in frequency bands used for two types of different communications systems, but using only one type of antenna element.

Another object of the present invention is to provide an antenna device which enables storage of a slide antenna and enables a portable radio to transmit and receive a signal in any of the frequency bands used by two types of different communications system.

To these ends, according to a first aspect of the present invention, there is provided an antenna device comprising:

feeding hardware attached to a housing of a portable radio; and a helical antenna element whose base end is connected to the feeding hardware, wherein the helical antenna element is caused to resonate at a first frequency as a ¼-wavelength helical antenna and to resonate at a second frequency lower than three times the first frequency as a ¾-wavelength helical antenna, by adjustment of an extended length and a winding pitch.

The ¼-wavelength helical antenna resonating at a first frequency f1 again reaches an impedance close to that at which the helical antenna resonates at the first frequency f1, at a second frequency f2 which is lower than three times the first frequency f1. Even when the ¼-wavelength helical antenna is used as a ¾-wavelength helical antenna, its standing-wave voltage ratio (SWVR) does not change at all.

Accordingly, it is possible to cause one helical antenna element connected at one end to feeding hardware to resonate at the first and second frequencies f1 and f2 by adjustment of an extended length and a winding pitch, thereby enabling transmission and reception of a signal in two different frequency bands.

According to a second aspect of the present invention, there is provided an antenna device comprising:

a rod antenna element which resonates at a first frequency as a ¼-wavelength whip antenna;

a movable contact section which is electrically connected to a base end of the rod antenna element and is continually provided in line with the rod antenna element;

an insulating cover which covers the rod antenna element;

a slide antenna section along an upper outer peripheral surface of which the insulating cover becomes exposed and along a lower outer peripheral surface of which the movable contact section becomes exposed;

feeding hardware which is attached to a housing of a portable radio, causes the slide antenna section to fit into a support hole formed in the center of the housing such that the slide antenna section comes out of and fits into the housing, and resiliently comes into contact with the outer peripheral surface of the slide antenna;

a first helical antenna resonates at a second frequency lower than three times the first frequency as a ¼-wavelength helical antenna by adjustment of an extended length and a winding pitch;

a second helical antenna whose base end is electrically connected to the feeding hardware; and joint hardware which connects the first helical antenna element tip end of the second helical antenna element, and resiliently comes into contact with the outer surface of the slide antenna section which comes out of and fits into the housing, wherein a fixed antenna section including the first helical antenna element, the joint hardware, and the second helical antenna element is made to resonate at the first frequency as a ¼-wavelength helical antenna and to resonate at the second frequency as a ¾-wavelength helical antenna, by adjustment of an extended length and winding pitch of the second helical antenna element;

when the slide antenna is pushed into the housing, the feeding hardware and the joint hardware come into resilient contact with an insulation cover, and the fixed antenna section electrically connected to the feeding hardware resonates at the first and second frequencies; and when the slide antenna is withdrawn from the housing, the feeding hardware and the joint hardware come into resilient contact with the movable contact section, both ends of the second helical antenna element are short-circuited by means of the movable contact section, and the rod antenna element electrically connected to the feeding hardware by way of the movable contact section and the first helical antenna element resonate at the first and second frequencies.

The slide antenna section is fitted into the support hole of the feeding hardware attached to the housing of the portable radio, so that the slide antenna section is pushed into or withdrawn from the housing.

When the slide antenna section is pushed into the housing, the rod antenna element and the feeding hardware are insulated by means of an exposed insulation cover along an upper outer peripheral surface of the slide antenna section. The fixed antenna section which includes the first helical antenna element, the joint hardware, and the second helical antenna element connected in series acts as both a ¼-wavelength grounded antenna whose base end is connected to feeding hardware and a ¾-wavelength grounded antenna. The fixed antenna section resonates at a first frequency f1 and a second frequency f2 lower than the first frequency f1.

When the slide antenna section is withdrawn from the housing, the slide antenna section is connected to the rod antenna element. The exposed movable contact section on the lower outer peripheral surface of the slide antenna section is electrically connected to both the feeding hardware and the joint hardware. Accordingly, the second helical antenna element whose both ends are connected to the feeding hardware and the joint hardware does not act as an antenna.

The first helical antenna element is connected at the base end to the feeding hardware by way of the joint hardware and the movable contact section and resonates at the second frequency f2 as a ¼-wavelength helical antenna. The rod antenna element is connected to the feeding hardware by way of the movable contact section connected to the base end of the rod antenna element and resonates at the first frequency f1 as a ¼-wavelength whip antenna.

Accordingly, the slide antenna section becomes retractable, and the antenna device can transmit and receive a signal at two different types of frequency bands whether the antenna is housed or withdrawn.

Briefly stated, the present invention provides first and second helical antenna elements that are connected in series with a radio signal. The first helical antenna element resonates at a first frequency as a ¼-wavelength antenna. The series combination of the first and second helical antenna elements resonates as a ¾ wavelength antenna at a second frequency respectively. The two frequencies differ by less than a factor of three. A retractable rod antenna shorts out one of the antenna elements in an extended position at which it is connected to the radio, and is disconnected from the radio in its retracted position. The rod antenna resonates as a ¼-wavelength antenna at said first frequency.

According to an embodiment of the invention, there is provided an antenna device for attachment to a portable radio comprising: feeding hardware attached to the portable radio, a helical antenna element, a base end of the helical antenna element connected to the feeding hardware, the helical antenna element having a winding length and a winding pitch effective to resonate the helical antenna element at a first frequency as a ¼-wavelength helical antenna and to resonate at a second frequency as a ¾-wavelength helical antenna, and the second frequency being less than three times the first frequency.

According to a feature of the invention, there is provided an antenna device for a portable radio comprising: a retractable rod antenna element, the rod antenna element having a length effective to resonate at a first frequency as a ¼-wavelength whip antenna, the radio including means for permitting movement of the rod antenna element between retracted and extended positions, a movable contact section electrically connected to a base end of the rod antenna element, the movable contact section being coaxial with the rod antenna element, an insulating cover covering the rod antenna element, a slide antenna section on the rod antenna element, an upper outer peripheral surface of the slide antenna section including the insulating cover becomes exposed when the rod antenna element is in its extended position, a conductive portion at a base portion of the rod antenna element, feeding hardware attached to the portable radio, the feeding hardware further including resilient means for contacting the outer peripheral surface of the slide antenna, a fixed antenna made up of a first helical antenna section and a second helical antenna section connected end to end, a second helical antenna section whose base end is electrically connected to the feeding hardware and whose outer end is connected in series with the first helical antenna section, the first and second helical antenna having lengths and winding pitches which renders a series combination of the first and second helical antennas resonant as ¼-wavelength antenna at a first frequency and as a ¾-wavelength antenna at a second frequency, the first and second frequencies differ by less than a factor of three, joint hardware connecting the first helical antenna element to the second helical antenna element, the joint hardware resiliently contacting an outer surface of the rod antenna as it moves between the extended and retracted positions, the feeding hardware and the joint hardware contacting the insulation cover when the rod antenna is in its retracted position, whereby and the fixed antenna section electrically connected to the feeding hardware resonates at the first and second frequencies, and when the rod antenna is in the extended position, the feeding hardware and the joint hardware come into resilient contact with the movable contact section, ends of the second helical antenna element are short-circuited by the movable contact section, and the rod antenna element is electrically connected to the feeding hardware by way of the movable contact section, whereby the first helical antenna element and the rod antenna resonate at the first and second frequencies.

According to a further feature of the invention, there is provided an antenna for a portable radio comprising: a first helical antenna, a second helical antenna connected at a first end to a first end of the first helical antenna, the first helical antenna and the second helical antenna having lengths and winding pitches effective to resonate as a ¼-wavelength antenna at a first frequency and as a ¾-wavelength antenna at a second frequency, a rod antenna, the rod antenna having a length effective to resonate as a ¼ wavelength antenna at the first frequency, means for permitting movement of the rod antenna between a retracted position and an extended position, a conductive portion on an exterior of the rod antenna, feeding hardware in the portable radio for feeding a radio signal to the antenna, the feeding hardware being permanently connected to a second end of the second helical antenna, the rod antenna being out of electrical contact with the feeding hardware in the retracted position, and the conductive portion short circuiting the second helical antenna and being connected to the feeding hardware in the extended position, whereby the rod antenna is connected as a ¼-wavelength antenna in the extended position.

According to a still further feature of the invention, there is provided an antenna for a portable radio comprising: a helical antenna, the helical antenna having a first portion having a first length and a first winding pitch effective to resonate as a ¼-wavelength antenna at a first frequency, and a second portion having a second length and a second winding pitch effective to resonate in series with the first portion as a ¾-wavelength antenna at a second frequency, a rod antenna, the rod antenna having a length effective to resonate as a ¼-wavelength antenna at the first frequency, means for permitting moving the rod antenna between a retracted position and an extended position, shorting means, effective in the extended position to short the second portion and to connect the rod antenna electrically in parallel with the first portion, and an insulation on the rod antenna effective, in the retracted position, to disconnect the rod antenna electrically from the helical antenna.

According to another feature of the invention, there is provided an antenna for a radio comprising: a helical antenna, the helical antenna having first and second portions, the first and second portions resonating at a first frequency and a second frequency, a rod antenna having an extended position and a retracted position, and means movable with the rod antenna for shorting one of the first and second portions, and for connecting the rod antenna electrically to the radio.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
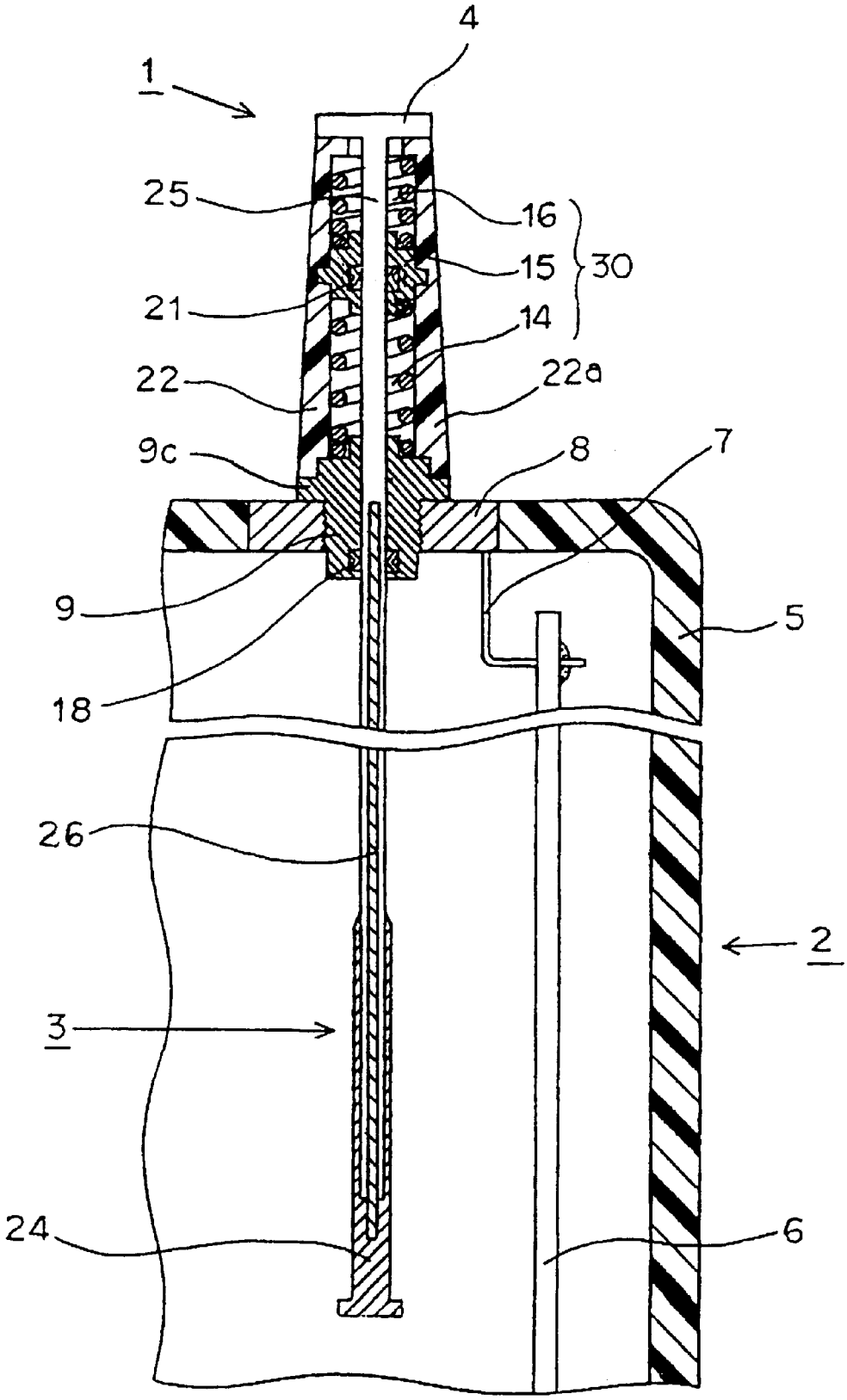
FIG. 1 is a cross-sectional view showing the principal elements of an antenna device according to one embodiment of the present invention when the antenna device is housed.

As shown in FIG. 1, in the case of an antenna device 1 according to one embodiment of the present invention, when a portable radio 2 is carried, a slide antenna section 3 is pressed to retract it into a housing 5 of the portable radio 2 (hereinafter referred to simply as an "housed state").

Figure 2:
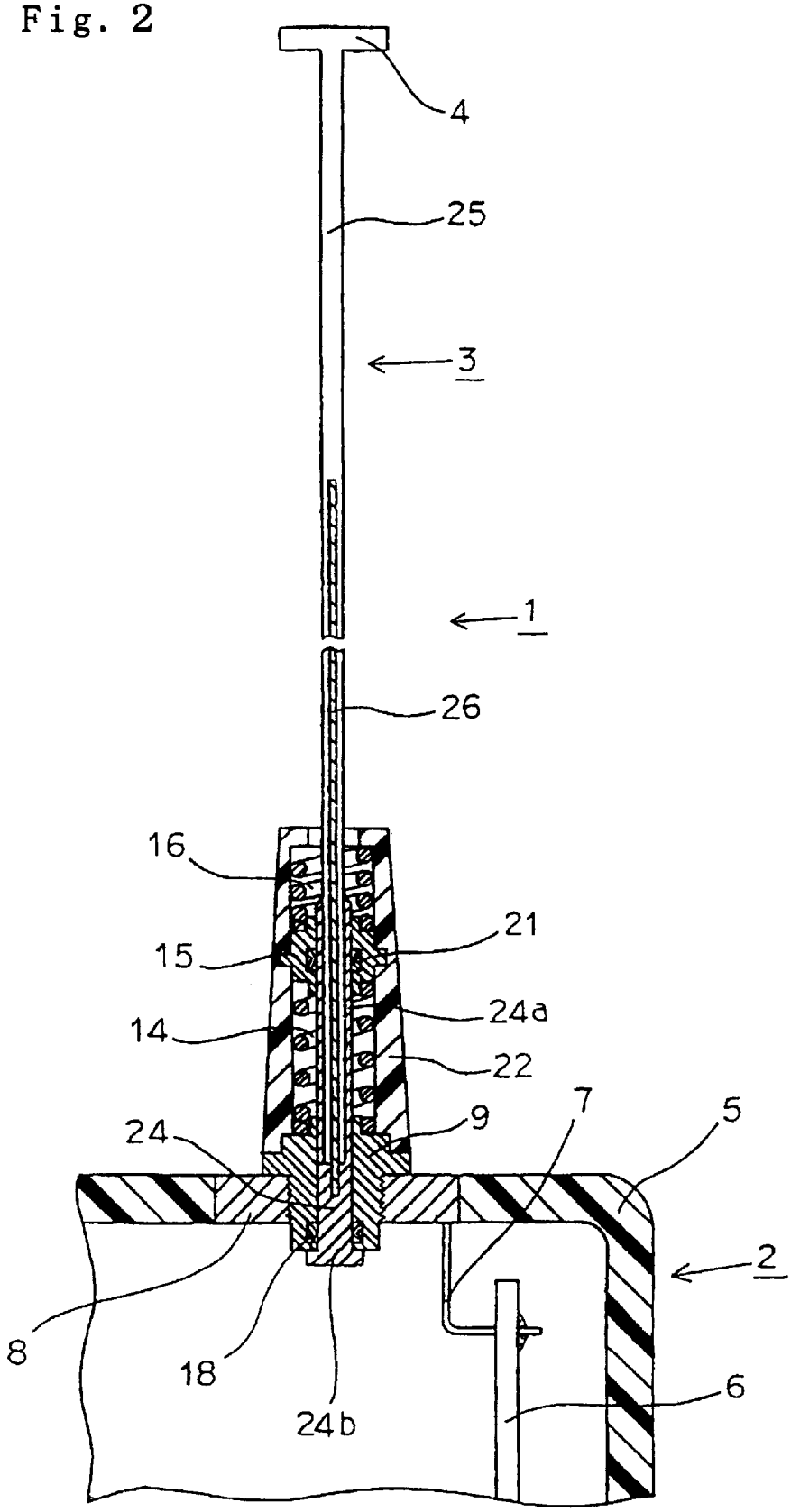
FIG. 2 is a cross-sectional view showing the principal elements of the antenna device when the antenna is extended.

As shown in FIG. 2, to provide a higher degree of sensitivity to a signal transmitted or received, an insulation tab 4 of the slide antenna section 3 is pulled up until the slide antenna section 3 is withdrawn from the housing 5 (hereinafter referred to simply as an "extended state").

A circuit board 6 is supported inside housing 5. High-frequency circuit component (not shown), constituting a transmission circuit, a reception circuit, and an antenna connecting circuit of the portable radio are mounted on circuit board 6. The antenna connecting circuit of the circuit board 6 is electrically connected to an attachment ring 8 mounted on the upper surface of the housing 5 by way of a feeding line 7.

A female screw 8*a* is formed on the interior surface of the attachment ring 8. Feeding hardware 9 is screwed into the attachment ring 8 until a flange 9*c* attached to the outer surface of the feeding hardware 9 comes into contact with the housing 5, whereby the feeding hardware 9 is attached to the housing 5. The feeding hardware 9 is substantially cylindrical. A support hole 10 is formed in the center of the feeding hardware 9. The support hole 10 has an inner diameter which is substantially identical with the outer diameter of the slide antenna 3 so as to fit the slide antenna section 3 into the housing and to retain the slide antenna section 3 while the antenna section is in the extended and housed states.

A recessed annular groove 9*e* (FIG. 3) is formed in the interior surface feeding hardware 9 so as to face the support hole 10. Cylindrical hardware 17 shown in FIG. 4 is fitted into the recessed annular groove 9*e*. The cylindrical hardware 17 is formed from an open ring having slits formed therein. The open nature of cylindrical hardware 17 permits it to expand and contract in a radial direction. The cylindrical hardware 17 is fitted into the recessed annular groove 9*e* while the ring is radially contracted.

A plurality of contact springs 18 are arranged at regular intervals along the circumference of the ring so as to protrude toward the inside of the ring. The plurality of contact springs 18 come into resilient contact with a plurality of different positions on the outer surface of the slide antenna section 3 fitted into the support hole 10.

Figure 3:
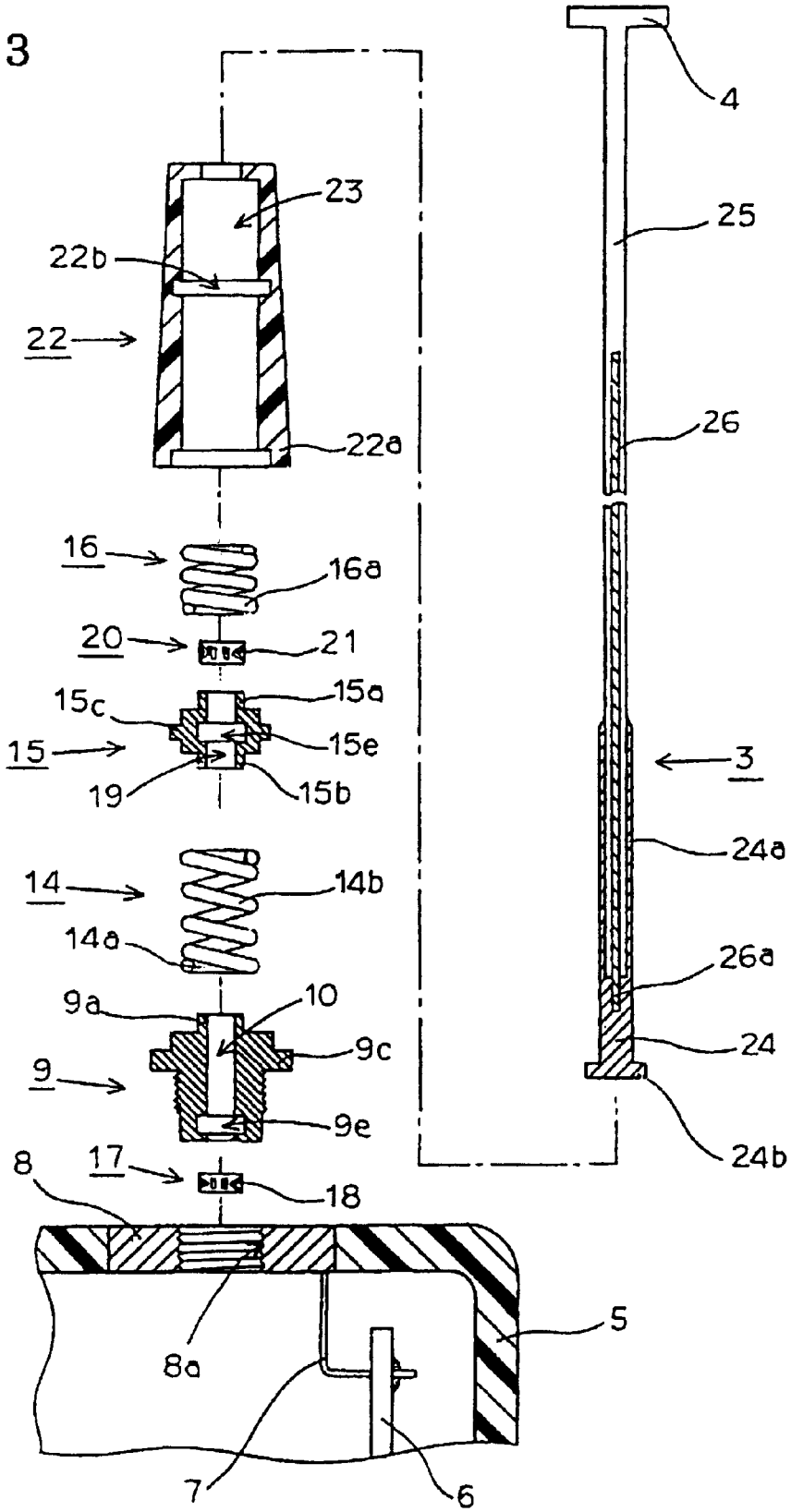
FIG. 3 is a partially-exploded cross-sectional view showing the constituent elements of the antenna device.
Figure 4:
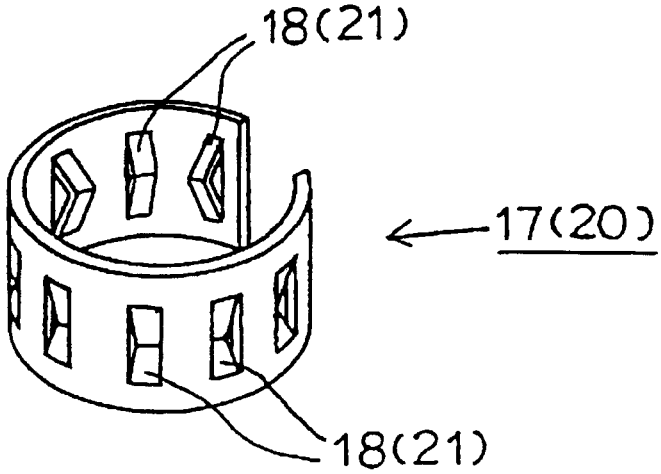
FIG. 4 is a perspective view showing cylindrical hardware

As shown in FIGS. 1 and 3, a fixed antenna section 30 comprising a first helical antenna element 16, joint hardware 15, and a second helical antenna element 14 is supported in an upright position on an upper cylinder section 9*a* of the feeding hardware 9. More specifically, a base end 14*a* of the second helical antenna element 14 is screwed into the upper cylinder section 9*a*. Further, a base end section 16*a* of the first helical antenna element 16 is screwed into a male screw formed in an upper cylinder section 15*a* of the joint hardware 15. A tip end 14*b* of the second helical antenna element 14 is screwed into a male screw formed in a lower cylinder section 15*b*. The first helical antenna element 16, the joint hardware 15, and the second helical antenna element 14 are electrically connected in series with one another and are supported on the feeding hardware 9 in an upright position.

A support hole 19, into which the slide antenna section 3 is fitted, is also formed in the joint hardware 15. A recessed annular groove 15*e* is formed in the interior surface of the joint hardware 15 facing the support hole 19. Cylindrical hardware 20 which is identical in structure with the foregoing cylindrical hardware 17 is fitted into the recessed annular groove 15*e*. Accordingly, when slide antenna section 3 is fitted into the support hole 19, contact springs 21 of the cylindrical hardware 20 come into resilient contact with a plurality of positions on the outer surface of the slide antenna section 3.

The first helical antenna element 16 is formed from a helically coiled piano line. The extended length and winding pitch of the piano line is adjusted so that the first helical antenna element 16 acts as a ¼-wavelength grounded antenna at a second frequency f2 (1.9 GHz) when its base end 16*a* is grounded. The second frequency f2 is in the frequency band used for transmission and reception operations of a personal handy-phone system. As will be described later, the portable radio 2 can be used as a personal handy-phone system.

Similarly, the second helical antenna element 14 is formed from a helically coiled piano line. The extended length and winding pitch of the second helical antenna element 14 are adjusted so that, when its base end 14*a* is grounded, the fixed antenna section 30 wholly acts as a ¼-wavelength grounded antenna at a first frequency f1 (900 MHz) and acts as a ¾-wavelength grounded antenna at the second frequency f2 (1.9 GHz). The first frequency f1 (900 MHz) is in the frequency band used for transmission and reception operations of an automobile telephone.

Figure 8:
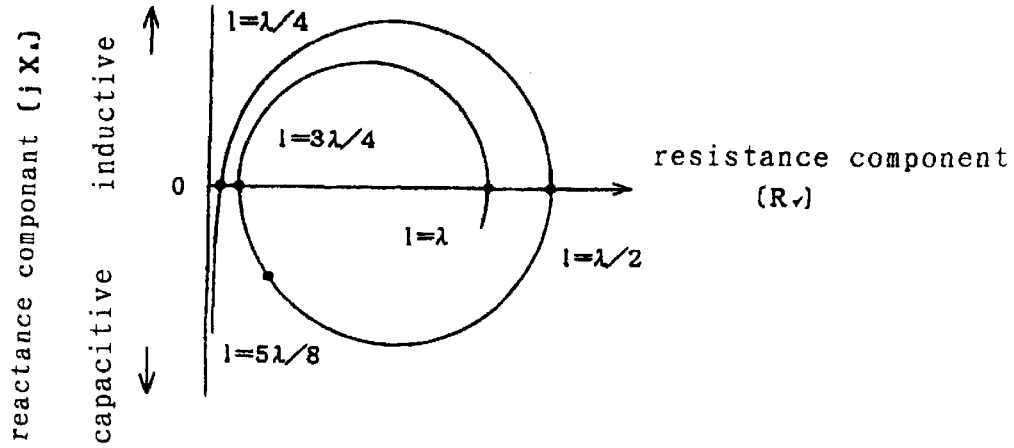
FIG. 8 is a diagram showing impedance of a whip antenna.
Figure 9:
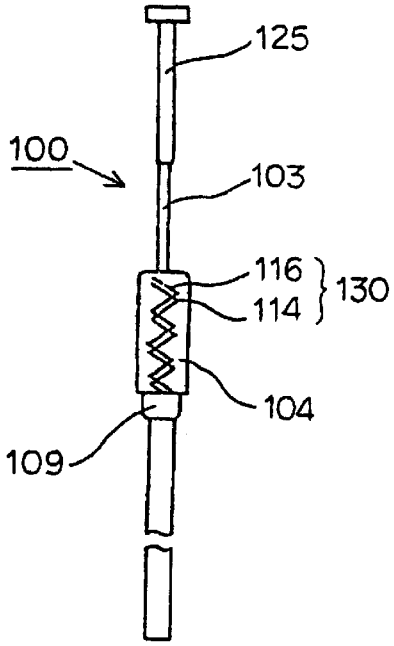
FIG. 9 is a partially-omitted front view showing a conventional antenna device.
Figure 10:
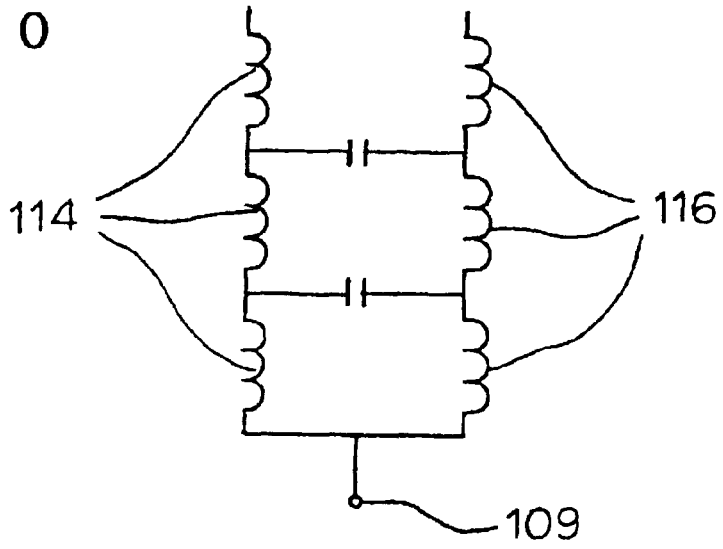
FIG. 10 is an equivalent circuit diagram showing the antenna device.
Figure 11:
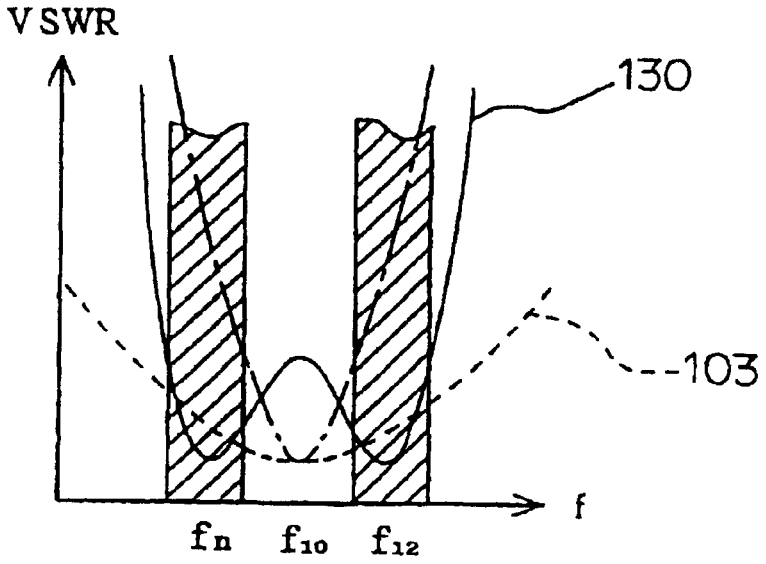
FIG. 11 is a plot showing the frequency characteristics of the antenna device.

FIG. 8 is a chart showing input impedance of a whip antenna having 1/l ("1" designates the length of an antenna conductor, and l designates a wavelength) as a parameter. As shown in the drawing, an unloaded ¼-wavelength rod antenna again becomes close to its basic impedance at a frequency which is three times the frequency of the rod antenna. Even when the rod antenna is used as ¾-wavelength antenna, no substantial changes arise in a standing-wave voltage ratio (SWVR). In contrast, if the whip antenna is a helical antenna, the influence of a capacitive component becomes greater as the frequency increases. The ¼-wavelength helical antenna can be used as ¾-wavelength helical antenna at a frequency lower than the three times the frequency of the helical antenna.

Accordingly, as mentioned previously, the fixed antenna section 30 is wholly made to act as a ¼-wavelength grounded antenna at 900 MHz and to act as a ¾-wavelength grounded antenna at a frequency of 1.9 GHz which is less than three times the frequency of 900 MHz, by adjustment of the extended length and winding pitch of the second helical antenna element 14 (the first helical antenna element 16 is already adjusted so as to act as a ¼-wavelength grounded antenna at the second frequency f2).

For example, the first and second helical antenna elements 16 and 14 are formed from a piano line having a diameter of 0.5 mm by coiling the piano line into a helical shape having an outer diameter of 6 mm. In a case where the first helical antenna element 16 is made by three and half turns of the piano line, solely the first helical antenna element 16 resonates a second frequency f2 of 1.9 GHz.

The first and second helical antenna elements 16 and 14 are wound a total of eight turns. The winding pitch of the helical antenna elements is adjusted until the fixed antenna section 30 wholly resonates at a first frequency f1 of 900 MHz and a second frequency f2 of 1.9 GHz. Therefore, the second helical antenna element 14 is made up of four and half turns of a piano line.

The first and second helical antenna elements 16 and 14 are formed into a helical shape having an inner diameter of 5 mm. Thus, the helical antenna elements have a sufficient diameter to permit insertion of an intermediate portion of the slide antenna section 3 without contact.

A cylindrical cap 22 includes a central insertion hole 23 passing therethrough. The insulation cap 22 is formed from a synthetic resin, such as a hard plastic, so as to cover the overall fixed antenna section 30 and to protect the helical antenna elements 16, 14 from external force. The base end 22*a* of the insulation cap 22 is fixed to the flange 9*c* of the feeding hardware 9 by means of an adhesive.

A ring groove 22*b* is recessed in the middle of an interior surface of the insulation cap 22. When the insulation cap 22 covers the fixed antenna section 30, the flange 15*c* of the joint hardware 15 is fitted into the ring groove 22*b*, thereby positioning the joint hardware 15. Accordingly, even when the antenna device is used for a long period of time, the winding pitch of the helical antenna elements 14,16 is protected from distortion and change, thereby preventing deterioration of the transmission and receiving characteristics.

FIG. 2 shows the insulation cap 22 attached to the feeding hardware 9 in the manner mentioned above. As shown in the drawing, the feeding hardware 9, the second helical antenna element 14, the joint hardware 15, and the first helical antenna element 16 are aligned with one another. The slide antenna section 3 is withdrawn along the axis of these elements.

As shown in FIG. 3, the slide antenna section 3 includes a rod antenna element 26, an insulation cover 25 covering an upper portion of the rod antenna element 26, and connection hardware 24 fixed to the base end of rod antenna element 26.

The rod antenna element 26 is formed from a piano line having a length of about 8 cm. Rod antenna element 26 acts as a ¼-wavelength whip antenna at a first frequency f1 of 900 MHz.

Rod antenna element 26 is covered with insulation cover 25 formed from insulating elastomer such as hard synthetic rubber in such a way that a base end 26*a* of the rod antenna element 26 is left uncovered.

The insulation cover 25 is continually provided on the rod antenna element 26 in line with each other. The insulation tab 4 is integrally formed with the upper end of the insulation cover 25. The outer diameter of the insulation tab 4 is greater than the inner diameter of the insertion hole 23 of the insulation cap 22. This prevents slide antenna section 3 from dropping into the housing 5 when the slide antenna section 3 is pressed into the housing 5. The tab 4 provides a finger hold for withdrawing the slide antenna section 3 to its operating position.

When the slide antenna section is housed, the insulation cover 25 insulates the circumference of the rod antenna element 26 from the feeding hardware 9 and the fixed antenna section 30. When the slide antenna section is extended, the insulation cover 25 covers the portion of the rod antenna element 26 protruding from the housing 5, thereby preventing the rod antenna element 26 from being deformed by external force and preventing damage to a human body.

The connection hardware 24 including a covering section 24*a*. A withdrawal stopper 24*b* is fixed to the base end 26*a* of the rod antenna element 26. When extended to its operating position, the rod antenna element 26 is electrically connected to the connection hardware 24.

Fixed attachment of the connection hardware 24 involves the base end of the insulation cover 25 being covered with the covering section 24*a* of the connection hardware 24, and the base end 26*a* of the rod antenna element 26 being directly caulked with the connection hardware 24.

The connection hardware 24 serves as a movable contact, and the covering section 24*a* is formed into a columnar shape having an external diameter substantially equal to the inner diameter of the support holes 10, 19 in such a way that the covering section 24*a* comes into resilient contact with the contact springs 18, 21. Further, the outer diameter of the withdrawal stopper 24*b* is larger than the inner diameter of the support hole 10 of the feeding hardware 9. Accordingly, when the slide antenna section 3 is withdrawn by pulling the insulation tab 4, the withdrawal stopper 24*b* comes into contact with the base end surface of the feeding hardware 9, thereby preventing the slide antenna section 3 from being dislodged. The position where the withdrawal stopper 24*b* contacts the power feeding hardware is defined as a withdrawn position. The contact springs 18 and 21 come into resilient contact with the connection hardware 24 which is a movable contact (see FIG. 2). In this extended state, the covering section 24*a* is fitted into the support holes 10 and 19. Consequently, the slide antenna section 3 protruding from the housing 5 is supported without backlash.

The following describes operation of the antenna device when the slide antenna section is housed and when the slide antenna section is extended.

As shown in FIG. 1, when the slide antenna section 3 is housed, the insulation tab 4 contacts the top of the insulation cap 22, and the rod antenna element 26 of the slide antenna section 3 is housed in the housing 5. Since the circumference of the rod antenna element 26 is covered with the insulation cover 25, the rod antenna element 26 is insulated from the feeding hardware 9 and the connection hardware 15 and does not act as an antenna.

Figure 5:
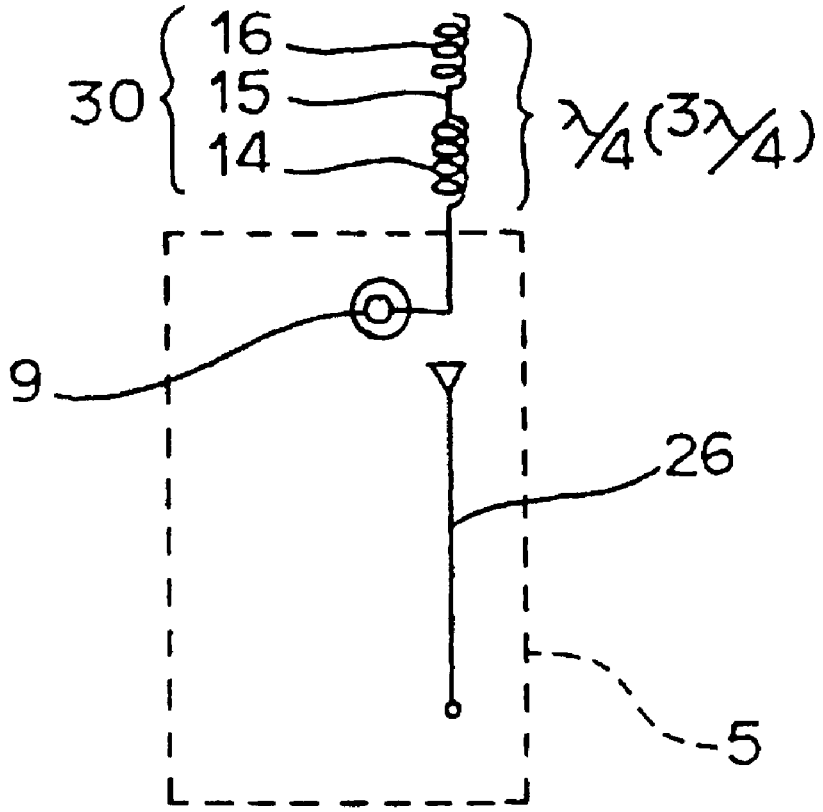
FIG. 5A is an equivalent circuit diagram showing the antenna device of a portable radio when the antenna is housed.
FIG. 5B is an equivalent circuit diagram showing the antenna device of the portable radio when the antenna is extended.
Figure 5:
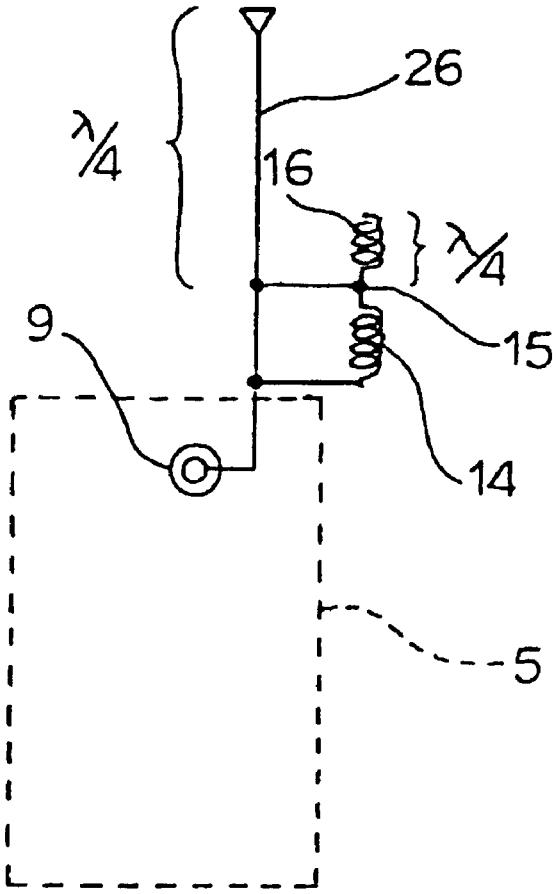

More specifically, as shown in FIG. 5A which represents the slid antenna section stored in the housing in the form of an equivalent circuit diagram, the feeding hardware 9 is connected solely with the fixed antenna section 30, consisting of the first helical antenna element 16, the connection hardware 15, and the second helical antenna element 14.

As mentioned previously, the fixed antenna section 30 is adjusted so as to act as a ¼-wavelength grounded antenna at a first frequency f1 of 900 MHz and as a ¾-wavelength grounded antenna at a second frequency f2 of 1900 GHz. In either of the first frequency f1 or the second frequency f2, the portable radio 2 enables dual-mode transmission and reception. At this time, the fixed antenna section 30 protrudes outwards from the housing 5 in an upright position. Further, the conductive rod antenna element 26 is not in the first helical antenna element 16 or the second helical antenna element 14, and is therefore quiescent. Accordingly, in each of the frequency bands, a transmission signal having large radiation power can be output, and superior receiving sensitivity is obtained.

Figure 6:
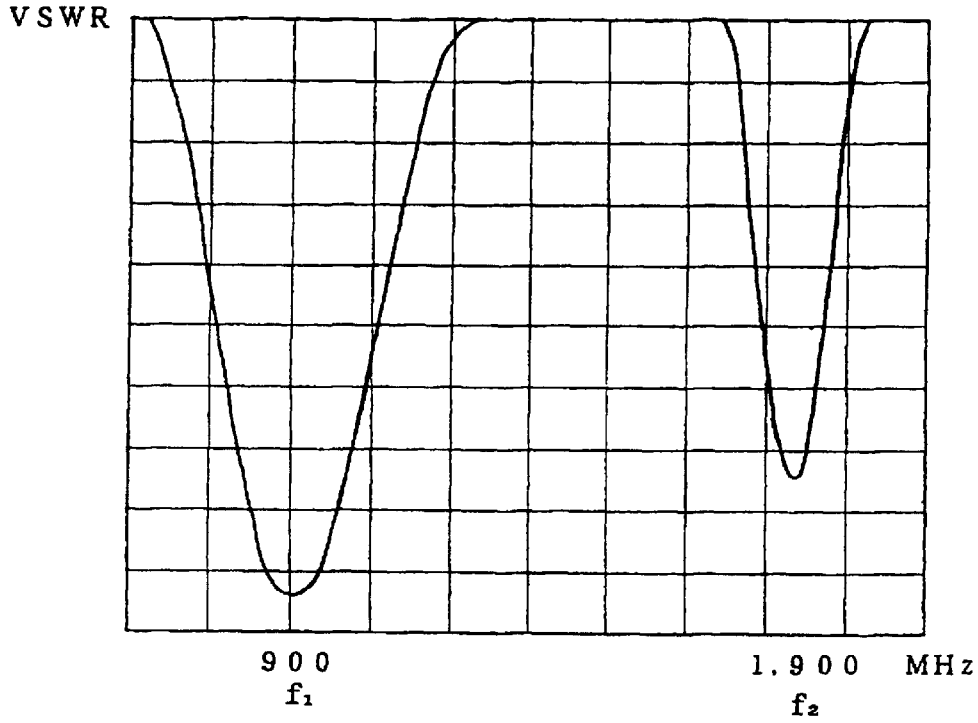
FIG. 6 is a graph showing the frequency characteristics of the antenna device 1 while the antenna is housed.

FIG. 6A shows the relationship between a frequency and a standing-wave voltage ratio (SWVR) when the slide antenna section is housed.

When the slide antenna section is housed, the rod antenna element 26 is located at a position lower than the feeding hardware 9. The rod antenna element 26 remains out of contact with the feeding hardware 9. For this reason, an intermediate portion of the rod antenna element 26 is not necessarily covered with the insulation cover 25.

The slide antenna section 3 is withdrawn from a housed position until the withdrawal stopper 24*b* of the connection hardware 24 comes into contact with the base end surface of the feeding hardware 9 by holding the insulation tab 4. As a result, as shown in FIG. 2, the covering section 24*a* of the connection hardware 24 comes into resilient contact with the contact springs 18, 21, thereby establishing electrical connection with the feeding hardware 9 and the connection hardware 15.

Accordingly, the second helical antenna element 14 having both ends 14*a* and 14*b* electrically connected to the feeding hardware 9 and the connection hardware 15 is short-circuited at both ends by means of the covering section 24*a* of the conection hardware 24. Therefore, the second helical antenna element 14 does not act as an antenna in this condition.

Figure 7:
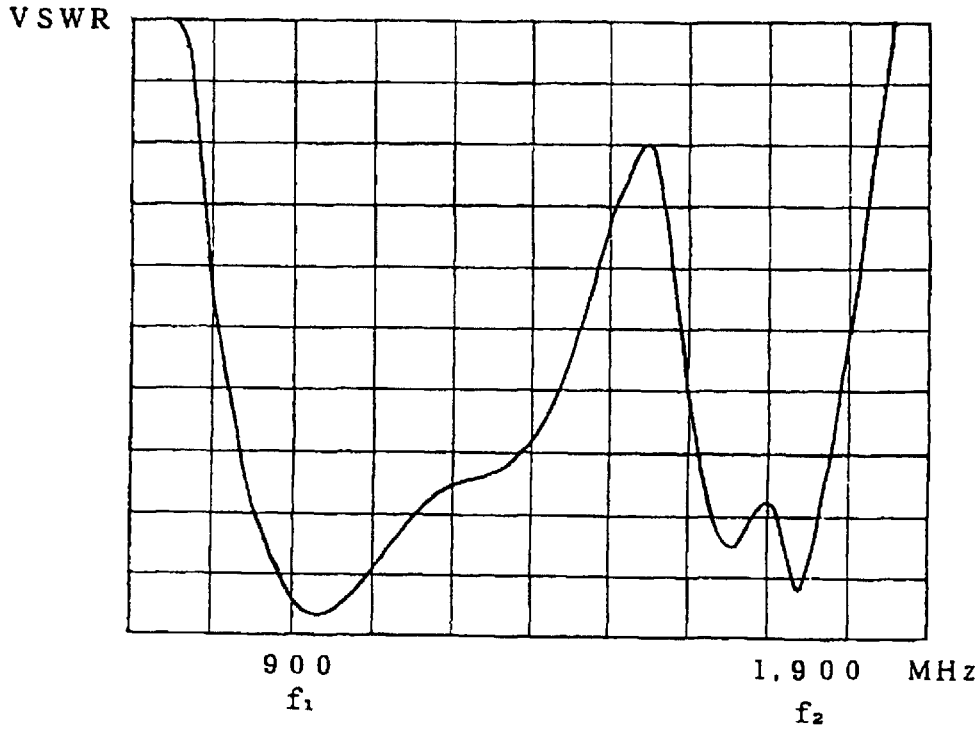
FIG. 7 is a graph showing the frequency characteristics of the antenna device 1 while the antenna is extended.

As shown in FIG. 5B, the ¼-wavelength first helical antenna element 16 whose resonance frequency is adjusted to the second frequency f2 of the portable radio 2 and the ¼-wavelength rod antenna element 26 whose resonance frequency is adjusted to the first frequency f1 are electrically connected in parallel to the feeding hardware 9. Accordingly, in an extended state, as shown in FIG. 7, the antenna device acts as a dual-mode antenna which resonates at the first frequency f1 (900 MHz) and at the second frequency f2 (1.9 GHz).

Since both the first and second helical antenna element 16 and the rod antenna element 26 protrude from the housing 5, a transmission signal having large radiation power can be output in each of the frequency bands, and superior receiving sensitivity can be ensured.

In the extended state, the covering section 24*a* of the connection hardware 3 is fitted into the support holes 10, 19 having substantially the same diameter as that of the covering section 24*a*. Accordingly, the slide antenna section 3 protruding from the housing 5 is supported without backlash.

The present invention is not limited to the foregoing embodiment and is susceptible to various modifications. For instance, in a case where there is no need to use a whip antenna and to cause the slide antenna section 3 to protrude from and to retract into the housing 5, there can be realized a dual-mode antenna device which resonates at two different frequencies through use of only the fixed antenna section 3. In this case, a fixed antenna section can be formed using only one helical antenna element into which the helical antenna element 16 and the second helical antenna element 14 are integrally joined together, without use of the connection hardware 15.

So long as the contact springs 18, 21 come into resilient contact with the outer surface of the slide antenna section 3, they are not required to be formed into an angularly-projecting form. For instance, part of each of the feeding hardware 9 and the connection hardware 15 is bulged toward the center of the support holes 10, 19, and the thus-bulging portion may be used as a contact spring.

As has been described, according to a first aspect of the present invention, so long as one helical antenna element is connected to feeding hardware, there can be realized a dual-mode antenna device which resonates at first and second resonance frequencies f1 and f2 used for two different types of communications systems.

The helical antenna element does not greatly protrude from the housing of the portable radio and hence does not cause any problem when the portable radio is carried with the helical antenna element being housed.

According to a second aspect of the present invention, a slide antenna section can be housed in a housing, and a portable radio can transmit and receive a signal at frequency bands used for two different types of communications systems regardless of whether the slide antenna section is housed or extended.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An antenna device for a portable radio comprising;

a retractable rod antenna element;

said rod antenna element having a length operable to resonate at a first frequency as a ¼-wavelength whip antenna;

said rod antenna element being movable between retracted and extended positions;

a movable contact section electrically connected to a base end of said rod antenna element;

said movable contact section being coaxial with said rod antenna element;

an insulating cover covering said rod antenna element;

a slide antenna section on said rod antenna element;

an upper outer peripheral surface of said slide antenna section including said insulating cover becomes exposed when said rod antenna element is in its extended position;

a conductive portion at a base portion of said rod antenna element;

feeding hardware attached to said portable radio;

said feeding hardware further including resilient means for contacting said outer peripheral surface of said slide antenna section;

a fixed antenna made up of a first helical antenna section and a second helical antenna section;

joint hardware electrically connecting said first helical antenna section with said second helical antenna section in series therewith a base end of said second helical antenna section being electrically connected to said feeding hardware;

said first and second helical antenna sections having lengths and winding pitches which renders a series combination of said first and second helical antenna sections resonate as a ¼-wavelength antenna at a first frequency and as a ¾-wavelength antenna at a second frequency;

said first and second frequencies differ by less than a factor of three;

said joint hardware resiliently contacting an outer surface of said rod antenna element as it moves between said extended and retracted positions;

said feeding hardware and said joint hardware contacting said insulation cover when said rod antenna element is in its retracted position, whereby said fixed antenna is electrically connected to said feeding hardware and resonates at said first and second frequencies; and when said rod antenna element is in said extended position, said feeding hardware and said joint hardware come into resilient contact with said movable contact section, ends of said second helical antenna section are short-circuited by said movable contact section, and said rod antenna element is electrically connected to said feeding hardware by way of said movable contact section, whereby said first helical antenna section and said rod antenna element resonate at said first and second frequencies.

2. An antenna for a portable radio comprising:

a first helical antenna, a second helical antenna;

joint hardware electrically connecting said second helical antenna in series with said first helical antenna;

said first helical antenna and said second helical antenna having lengths and winding pitches operable to resonate as a ¼-wavelength antenna at a first frequency and as a ¾-wavelength antenna at a second frequency;

a rod antenna;

said first and second frequencies differ by less than a factor of three;

said rod antenna having a length operable as a ¼-wavelength antenna at said first frequency;

said rod antenna being movable between a retracted position and an extended position;

a conductive portion on an exterior of said rod antenna;

feeding hardware in said portable radio for feeding a radio signal to said antenna;

said feeding hardware being permanently connected to said second helical antenna;

said rod antenna being out of electrical contact with said feeding hardware in said retracted position; and said conductive portion short circuiting said second helical antenna and being connected to said feeding hardware in said extended position, whereby said rod antenna is connected as a ¼-wavelength antenna in said extended position.

3. An antenna for a portable radio comprising:

a helical antenna;

said helical antenna having a first portion having a first length and a first winding pitch operable to resonate as a ¼-wavelength antenna at a first frequency, and a second portion electrically connected in series with said first portion, said second portion having a second length and a second winding pitch operable to resonate in series with said first portion as a ¾-wavelength antenna at a second frequency;

said first and second frequencies differ by less than a factor of three;

a rod antenna;

said rod antenna having a length operable to resonate as a ¼-wavelength antenna at said first frequency;

said rod antenna being movable between a retracted position and an extended position;

shorting means, operable with said rod antenna in extended position to short said second portion and to connect said rod antenna electrically in parallel with said first portion; and an insulation on said rod antenna operable with said rod antenna, in said retracted position, to disconnect said rod antenna electrically from said helical antenna.

* * * * *